United States Patent [19]

Machida

[11] 4,388,616

[45] Jun. 14, 1983

[54] FIRE DETECTION SYSTEM WITH PROGRAMMED SENSITIVITY CHANGES

[75] Inventor: Haruchika Machida, Sagamihara, Japan

[73] Assignee: Hochiki Corporation, Tokyo, Japan

[21] Appl. No.: 240,646

[22] Filed: Mar. 5, 1981

[30] Foreign Application Priority Data

Mar. 19, 1980 [JP] Japan ..... 55-35108

[51] Int. Cl.[3] ..... G08B 17/06

[52] U.S. Cl. ..... 340/587; 169/23; 169/61; 340/501; 340/628; 340/629

[58] Field of Search ..... 340/628, 629, 587, 501; 169/61, 60, 56, 23

[56] References Cited

U.S. PATENT DOCUMENTS 4,097,851 6/1978 Klein ..... 340/628

4,101,785 7/1978 Malinowski ..... 340/501

*Primary Examiner*—Glen R. Swann, III

*Attorney, Agent, or Firm*—Fliesler, Dubb, Meyer & Lovejoy

[57] ABSTRACT

In a fire detection system having at least one fire sensor, a receiver including a power source connected to the fire sensor for supplying a power source voltage to the fire sensor and a receiving relay for receiving a fire detection signal from the fire sensor, and at least one power/signal line for coupling the fire sensor to the receiver, the receiver comprises a timer for producing a clock signal over the time of day and command means for providing predetermined detection sensitivity change commands of the fire sensor which are programmed according to the time of day in response to the clock signal from the timer, and the fire sensor comprises sensitivity change control means for changing the detection sensitivity of the fire sensor in response to the detection sensitivity change command from the command means. The fire detection sensitivity of the fire sensor is varied in accordance with predictive fire damage conditions predetermined in view of the activities of people during the time of day. The system can realize an early discovery of fire to minimize the fire damage.

12 Claims, 13 Drawing Figures

1
2
TIMER
3
IN ITF
B
5
OUT ITF
4
COMPUTER
CPU
4a
ROM
4b
RAM
4c
6a
V/f
6n
V/f
Ca
Cn
RLa
RELAY
7a
RELAY
RLn
7n
9
La
Lo
Ln
Lo
8a
8n
Sa1
Sa1
Sn1
Snm

To Fire Extinguishing Installation
i
fa
-V
rla
rln
FA
RELAY
I
RELAY
+V
15
I/O ITF
OUT ITF
5
B
3
IN ITF
2
TIMER
1
4
CPU
4a
ROM
4b
RAM
4c
COMPUTER
+V
9
-V
6a
V/f
Ca
RELAY
RLa
7a
La
8a
Sa1
Sar
Lo
6n
V/f
Cn
RELAY
RLn
7n
Ln
8n
Sn1
Snr
Lo

FIRE DETECTION SYSTEM WITH PROGRAMMED SENSITIVITY CHANGES

BACKGROUND OF THE INVENTION

The present invention relates to a fire detection system in which a preset fire detection sensitivity pattern is produced from a receiver to change the fire detection sensitivity of a fire sensor in accordance with the time of day.

In general, the fire detection sensitivity of a conventional fire sensor is fixedly set at a given value in view of a given fire monitoring area, when the fire sensor is installed. Actually, the sensitivity is set to be slightly higher than the given value in order to secure a reliable detection of fire at the worst. For this reason, there is the possibility that non-fire alarms are produced. Particularly when someone is in a room, the non-fire alarm is likely to be issued because tobacco smoke or heat is necessarily produced. In this case, therefore, it is desirable to set the sensitivity of the sensor at a lower level. From this viewpoint, Japanese Laid-Open Patent Application Publication No. 20, 900/78 discloses a fire detection system which checks as to whether someone is in a room or not, by interlocking a checking portion with the operation of a door key or a lamp switch of the room, and sets the sensitivity of the sensor at a higher level when no person is in the room, so that an early detection of a fire is secured.

As mentioned above, however, the prior fire detection system changes the sensitivity only in accordance with a checked result as to whether the lamp is on or off, or whether someone is in the room or not. While this prior fire detection system has the likelihood of an earlier fire detection compared with a fire detection system in which the sensitivity is fixed, the prior fire detection system, although having such an advantage, has a problem in that the accuracy of detecting a room condition is relatively low and accordingly frequent erroneous fire alarms are likely to be issued adversely.

D. J. Rasbash has disclosed in his paper entitled "The role of fire detection systems in protection against fires", Proceedings of the Symposium on Automatic Fire Detection, London, March 8–10, 1972, a statistical consideration of fire occurrences during the time of day, i.e., the probability ($P_L$) of fires in buildings (other than dwellings) becoming large during the time of day and the probability ($P_F$) of a fatal fire occurring in multi-floor houses during the time of day. According to this study, $P_L$ and $P_F$ are higher by about three times during the night, particularly at dawn when people are hardly active than during the daytime when people are active.

The fire detection system as disclosed in Japanese Laid-Open Patent Application Publication No. 20,900/78 can not deal with the above-described state of fire occurrences, the probability of which varies in accordance with the time of day, and hence it still involves the problem of erroneous fire alarm issuance.

SUMMARY OF THE INVENTION

In view of the foregoing, the present invention has as an object to provide a fire detection system which can realize an early discovery of fire to minimize the fire damage in a manner that the fire detection sensitivity of a respective fire sensor is varied in accordance with predictive damage conditions such as the probabilities $P_L$, $P_F$ or the like, in response to a sensitivity change commnd issued from a receiver, which command is produced in accordance with a sensitivity change pattern during the time of day preset in accordance with the state of activities of people in a specific fire monitor area.

In a fire detection system according to the present invention, a receiver has a command means for issuing a sensitivity change command of a fire sensor, which command changes in accordance with a predetermined pattern of sensitivity in response to a clock signal produced from a timer. The fire detection system has a sensitivity change control means for changing the fire detection sensitivity in response to the sensitivity change command from the command means.

According to one aspect of the invention, in a fire detection system having at least one fire sensor, a receiver including a power source connected to the fire sensor for supplying a power source voltage to the fire sensor and a receiving relay for receiving a fire detection signal from the fire sensor, and at least one power/signal line for coupling the fire sensor to the receiver, the receiver comprises a timer for producing a clock signal over the time of day and command means for providing at least one predetermined detection sensitivity change command of the fire sensor which is varied according to the time of day in response to the clock signal from the timer, and the fire sensor comprises sensitivity change control means for changing the detection sensitivity of the fire sensor in response to the detection sensitivity change command from the command means.

In a preferred embodiment of the present invention, the command means includes a computer having a read only memory for storing a detection sensitivity pattern predetermined according to the time of day and reading out a present detection sensitivity from the read only memory in response to the clock signal from the timer to produce a present detection sensitivity signal, converting means for converting the present detection sensitivity signal to a frequency signal, and at least one first capacitor inserted between the converting means and the at least one power/signal line, and the fire sensor includes a low-pass filter and a second capacitor which are connected to the power/signal line, a smoke sensing portion and a fire judging section, to both of which a power source voltage derived from the low-pass filter is applied, and a switching element for producing the fire detection signal. The frequency signal is supplied through the second capacitor to the sensitivity change control means, and the sensitivity change control signal derived from the sensitivity change control means and the output signal from the smoke sensing portion are supplied to the fire judging section, so that the switching of the switching element is controlled by the output signal from the fire judging section.

The detection sensitivity derived from the computer may be a digital signal. In this case, the converting means may include a D/A converter for converting the digital signal to an analog voltage and a V-F converter for converting the analog signal to the frequency signal. The sensitivity change control means may be an F-V converter for converting the frequency signal into a voltage signal. The fire judging section may be an operational amplifier. The switching element may be a thyristor, the gate of which is connected to the output terminal of the operational amplifier and the anode and the cathode of which are connected to the low-pass filter.

In another preferred embodiment of the present invention, a plurality of fire sensors are provided corresponding to a plurality of fire sensing systems, respectively. The command means includes a computer having a read only memory for storing a plurality of detection sensitivity patterns predetermined according to the time of day corresponding to the plurality of fire sensing systems, in which the computer reads out the present detection sensitivities from the read only memory in response to the clock signal derived from the timer to produce present detection sensitivity signals corresponding to the respective fire sensing systems, and converting means for converting the detection sensitivity signals to frequency signals. A plurality of first capacitors are connected respectively between the converting means and a plurality of power/signal lines corresponding to the fire sensing systems. Each sensor may include a low-pass filter and a second capacitor which are connected to the power/signal line, a smoke sensing portion and a fire judging section to both of which a power voltage derived from the low-pass filter is applied, and a switching element for producing the fire detection signal. The frequency signal is supplied through the second capacitor to the sensitivity change control means, and the sensitivity change control signal derived from the sensitivity change control means and the output signal from the smoke sensing portion are supplied to the fire judging section, so that the switching of the switching element is controlled by the output signal from the fire judging section.

In a further preferred embodiment of the present invention, a plurality of fire sensors are provided corresponding to a plurality of fire sensing systems, respectively, the command means includes a computer having a read only memory for storing a detection sensitivity pattern predetermined according to the time of day, in which the computer reads out a present detection sensitivity from the read only memory in response to the clock signal derived from the timer to produce present detection sensitivity signals corresponding to the respective fire sensing systems, converting means for converting the present detection sensitivity signals to frequency signals, and first capacitors connected between the converting means and a plurality of power/-signal lines corresponding to the fire sensing systems. Each sensor includes a low-pass filter and a second capacitor which are connected to the power/signal lines, a smoke sensing portion and a fire judging section, to both of which a power source voltage derived from the low-pass filter is applied, and a switching element for producing the fire detection signal. The frequency signal is supplied through the second capacitor to the sensitivity change control means, and the sensitivity change control signal derived from the sensitivity change control means and the output signal from the smoke sensing portion are supplied to the fire judging section, so that the switching of the switching element is controlled by the output signal from the fire judging section.

In a still further embodiment of the present invention, the command means includes a computer having a read only memory for storing at least one detection sensitivity pattern predetermined according to the time of day, in which the computer reads out a present detection sensitivity from the read only memory in response to the clock signal from the timer to produce at least one present detection sensitivity signal, and power source voltage control means for changing the power source voltage derived from the power source in response to the present detection sensitivity signal to supply the changed power source voltage to the receiving relay and the fire sensor. The sensor includes a low-pass filter connected to the at least one power/signal line, and a smoke sensing portion, a fire judging section, a constant voltage circuit and a switching element for producing the fire detection signal to which the power voltage from the low-pass filter is applied. The sensed output signal from the smoke sensing portion and a reference level from the constant voltage circuit are supplied to the fire judging section, so that the switching of the switching element is controlled by the output signal from the fire judging section.

A fire detection system according to the invention may further comprise an interlock enabling relay which operates when the predetermined sensitivity change command produced from the command means exceeds a predetermined value, and a fire alarm relay which operates when any one of the receiving relays operates, so that a fire extinguishing installation is operated when the fire alarm relay operates under a condition that the interlock enabling relay operates.

In a fire detection system according to the present invention, two types of sensitivity patterns for a weekday and a holiday may be written in the read only memory.

DETAILED DESCRIPTION OF THE PREFERRED EMBODIMENTS

Figure 1:
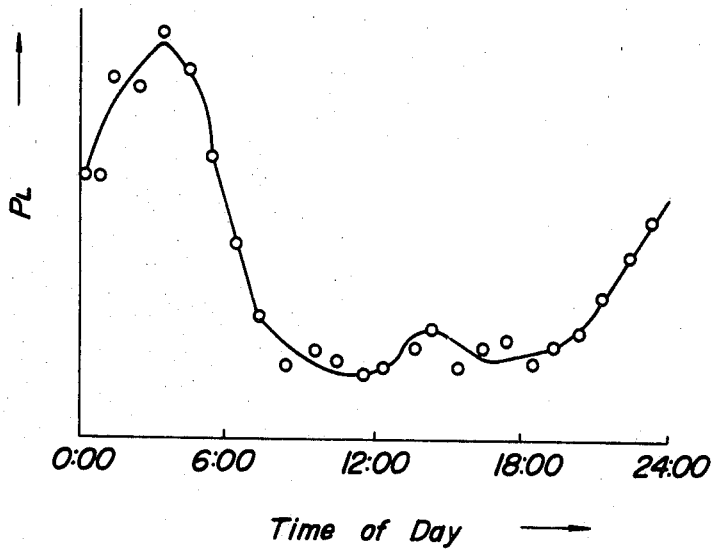
FIG. 1 illustrates the probability $P_L$ of fires in buildings (other than dwellings) according to the time of day.
Figure 2:
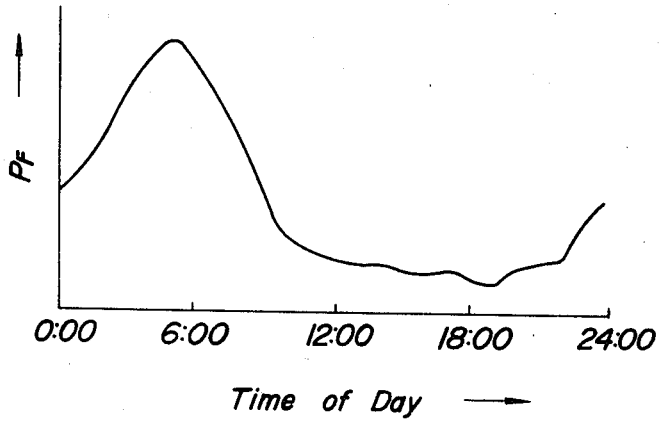
FIG. 2 illustrates the probability $P_F$ of fatal fires occurring in multi-floor houses according to the time of day.

FIG. 1 illustrates one example of the probability $P_L$ of fires in buildings (other than dwellings) becoming large according to the time of day and FIG. 2 illustrates one example of the probability $P_F$ of fatal fires occurring in multi-floor houses according to the time of day. FIGS. 1 and 2 indicate that the probabilities $P_L$ and $P_F$ during the night, particularly during the dawn during which people are hardly active, are approximately three times higher than those during the daytime during which people are active.

Figure 3:
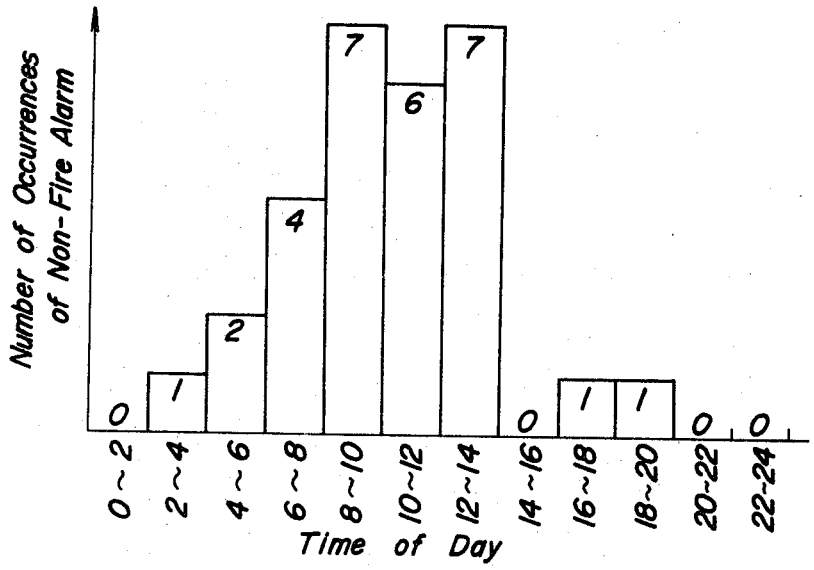
FIG. 3 illustrates the frequency of non-fire alarms according to the time of day.

From the viewpoint that the damage by fires during the night is larger than that during the daytime, as mentioned above, it may be considered to change the fire detection sensitivity along a curve illustrated in FIG. 1 or 2 according to the time of day. The approach of merely changing the sensitivity following such a curve, however, may have the possibility of providing an erroneous alarm of a fire or a non-fire alarm. In this respect, the inventors have collected and statistically analyzed data about non-fire alarm occurrences. The result of this statistical analysis is illustrated in FIG. 3 in the form of a graph illustrating a frequency of non-fire alarms over a two-hour time range during the time of day. For the data collection, ionized smoke sensors were installed in an airshed over a period from June 2, 1978 to July 19, 1979. As seen from FIG. 3, the number of occurrences of non-fire alarms was twenty nine in total during the entire range of the period. The number of the non-fire alarm occurrences during the daytime is larger than that during the night. This result can be estimated from the fact that, during the daytime, the atmosphere of a smoke sensor is disturbed by various activities of people.

Figure 4:
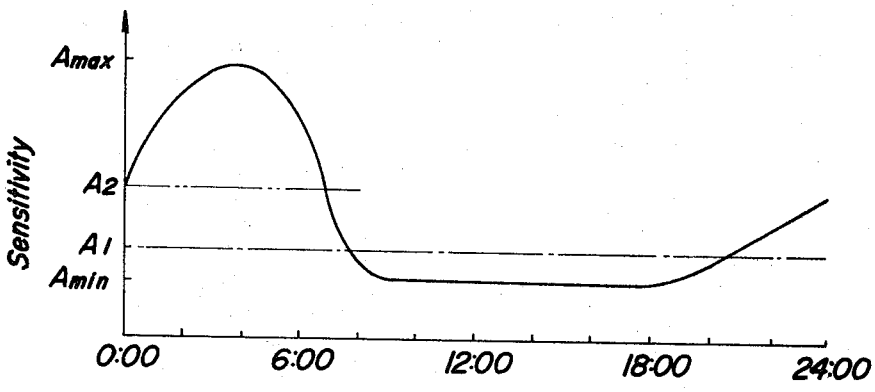
FIG. 4 illustrates a sensitivity pattern used in the present invention.

The inventors have considered the statistical data in FIGS. 1 and 2 in view of the data in FIG. 3, and have found that an effective fire detection system with less number of erroneous alarms is realized by changing the fire sensitivity of each of the fire sensors in accordance with a sensitivity pattern which is preset according to the time of day as illustrated in FIG. 4. The preset sensitivity pattern is principally formed on the basis of the most general tendency of fire occurrences expressed by the probabilities $P_L$ and $P_F$ illustrated in FIGS. 1 and 2 in view of the distribution of non-fire alarms illustrated in FIG. 3. During a time zone during which much damage by fires can be predicted, the sensitivity of the fire sensor is set to be higher than a normal sensitivity A1. On the other hand, during a time zone during which it is practical to extinguish a fire at the start since people are active, the sensitivity is set to be lower than the normal sensitivity A1 in order to avoid an erroneous non-fire alarm by causes other than fires, such as tobacco smoke. In the example of FIG. 4, a sensitivity is set lower than the normal sensitivity A1 from 7:30 a.m. to 9:00 p.m., and it is fixed at a minimum sensitivity $A_{min}$ especially from 9:00 a.m. to 6:00 p.m. From 9:00 p.m. to 7:30 a.m. the sensitivity curve has a maximum value $A_{max}$ at about 4:00 a.m. and has a pattern of upwardly curving toward 4:00 a.m. and downwardly curving toward 7:30 a.m.

Figure 5:
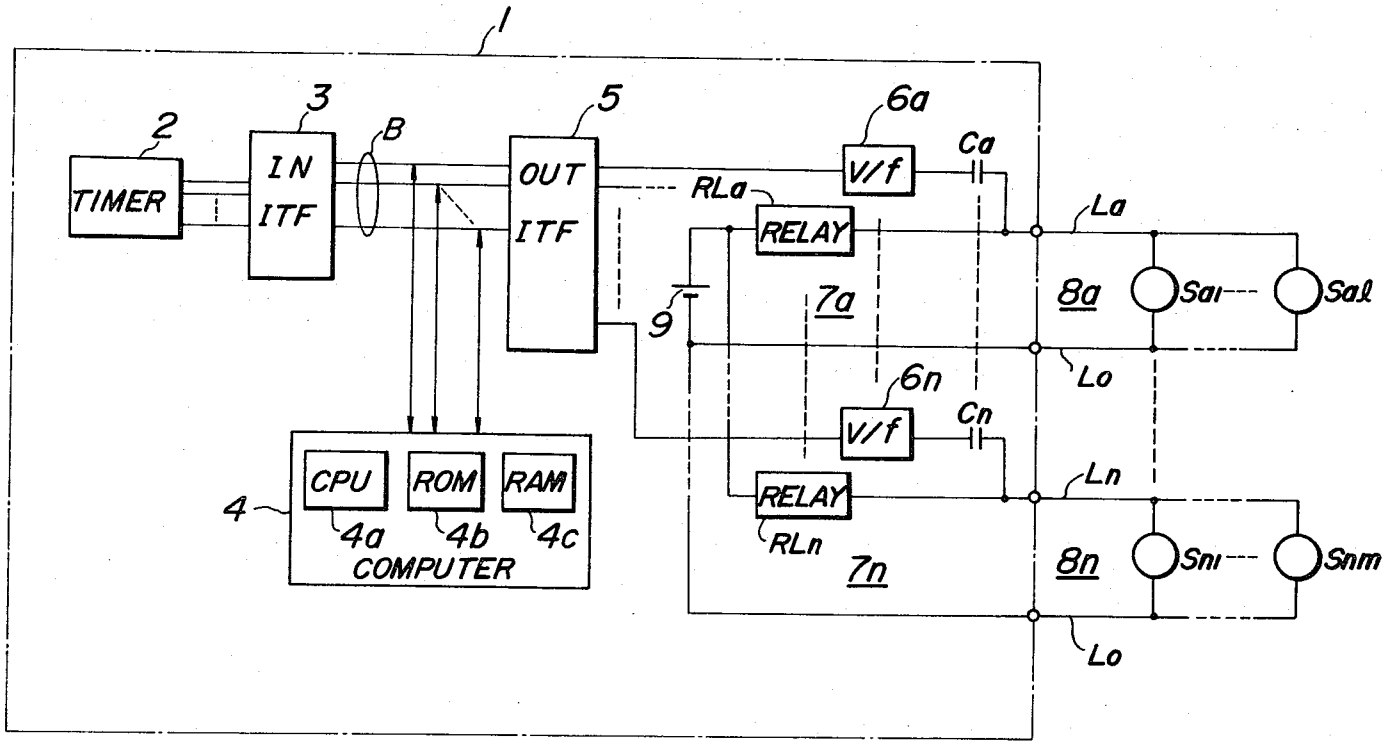
FIG. 5 is a block diagram showing an embodiment of a fire detection system according to the present invention.

An embodiment of a fire detection system using such a sensitivity pattern according to the present invention is shown in FIG. 5. It will expressively be understood that a sensitivity pattern to be used in the invention is not limited to that illustrated in FIG. 4 but may variously be modified in accordance with various circumstances where fire sensors are to be installed.

Figure 6:
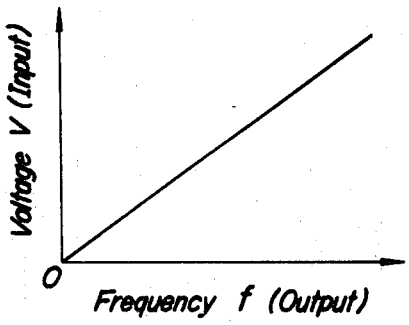
FIG. 6 illustrates an input/output characteristic of a V-F converter used in the fire detection system shown in FIG. 5.

As shown in FIG. 5, a central receiving control section 1 having a fire receiver comprises a timer circuit 2, for example, an A-145 manufactured by AI Electronics Corporation in Japan, for producing a clock signal of the time of day in the form of, for example, BCD code, a computer 4 which receives the clock signal from the timer circuit 2 through an input interface 3 such as an I/O interface, e.g. an iSBC508 of Intel and a bus B, an output interface 5 such as a combination of an I/O interface, e.g. an iSBC508 of Intel and an A/D converter, e.g. an AD7520 of Intersil, which receives an output signal from the computer 4 via the bus B to convert the received output signal to an analog signal. The computer 4, for example, a microcomputer system has a central processing unit (CPU) 4*a*, a read only memory (ROM) 4*b* which stores a control program and a sensitivity pattern of a fire sensor changing according to the time of day, for example, a sensitivity pattern as illustrated in FIG. 4, and a random access memory (RAM) 4*c* for temporarily storing data. For example, an iSBC80/04 of Intel may be used as the computer 4. Accordingly, the computer 4 produces a present sensitivity command, for example, in the form of a voltage signal in response to the sensitivity value stored in the ROM 4*b* in response to the clock signal from the timer circuit 2, through the output interface 5. The output lines of the output interface 5 are connected to voltage to frequency (V-F) converters 6*a*, . . . , 6*n* for converting the sensitivity change command in the form of the voltage signal into a frequency signal having a frequency corresponding to the voltage value of the voltage signal. The V-F converters 6*a*, . . . , 6*n* have each a V-F characteristic as illustrated in FIG. 6 and may be comprised of a voltage controlled oscillator (VCO) for producing an a.c. signal having a frequency proportional to the magnitude of the voltage signal. The VCO may be a "4154" of RAYTHEON. The V-F converters 6*a*, . . . , 6*n* produce a.c. signals having frequencies corresponding to the sensitivity commands. The a.c. signals are then transferred to sensor lines La, . . . , Ln through d.c. blocking capacitors Ca, . . . , Cn, respectively. Via these sensor lines La, . . . , Ln, serving as power and signal lines, receiving relays RLa, . . . RLn constituting fire receivers 7*a*, . . . , 7*n* are connected to fire sensing systems 8*a*, . . . , 8*n*, respectively, having groups of fire sensors Sa1 to Sal, . . . , Sn1 to Snm which are connected in parallel with one another in the respective groups. A d.c. power source 9 supplies a d.c. voltage to the receiving relays RLa, . . . , RLn and sensors Sa1 to Sal, . . . , Sn1 to Snm. A common line Lo is commonly connected between the sensors Sa1 to Sal, . . . , Sn1 to Snm and the power source 9. The blocking capacitors Ca, . . . , Cn respectively block the d.c. voltage, which is directed to the sensors Sa1 to Sal, . . . , Sn1 to Snm, from being applied to the V-F converters 6*a*, . . . , 6*n*. The fire sensing systems 8*a*, . . . 8*n* may be installed at the respective floors in a building, for example. When any one of the sensors in any one of the systems operates, the receiving relay in the corresponding receiver operates to produce an alarm signal.

Figure 7:
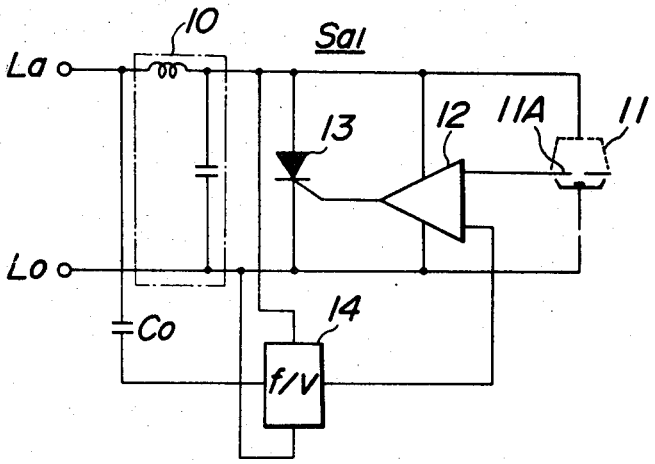
FIG. 7 is a circuit diagram showing an embodiment of a fire sensor used in the fire detection system shown in FIG. 5.
Figure 8:
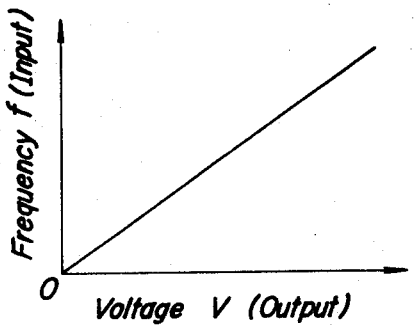
FIG. 8 illustrates an input/output characteristic of an F-V converter used in the fire detection system shown in FIG. 5.

Each of the fire sensors Sa1 to Sal, . . . , Sn1 to Snm has sensitivity change control means for changing the sensitivity in response to the sensitivity change command from the V-F converter. An embodiment of the fire sensor is shown in FIG. 7. While FIG. 7 only shows the sensor Sa1 connected to the sensor line La, the remaining sensors have the same circuit arrangement. In FIG. 7, the d.c. voltage from the d.c. power source 9 and the frequency signal or a.c. component as the sensitivity change command each from the V-F converters 6*a*, . . . , 6*n* are superposedly applied to the sensor line La. A conventional low-pass filter 10 comprised, for example, of a coil and a capacitor picks up only the d.c. component from the superposed signal. The d.c. component serves as a power source for the sensors Sa1 to Sal. The filter 10 is connected in parallel with a smoke sensing portion 11 having an ionized type smoke chamber, for example, which operates when the d.c. component as the power source voltage is supplied, a fire judging section 12, such as an operational amplifier, which produces an output signal when the output signal derived from an intermediate electrode 11A of the smoke sensing portion 11 exceeds a predetermined level, and a switching element 13, such as a thyristor or transistor, which is rendered conductive by the output signal from the fire judging device 12 to transmit an alarm signal in the form of an increase of the d.c. current to the receiver 1. The line La is further connected via a capacitor Co to an F-V converter 14 as the sensitivity change control means which receives the frequency signal as the sensitivity change command obtained by blocking the d.c. component from the power source 9 by the capacitor Co to convert the frequency signal to a corresponding voltage signal. The F-V converter may be a "4151" manufactured by RAYTHEON and the output signal from the F-V converter 14 is applied as a reference signal to the fire judging section 12. The F-V converter 14 has an F-V converting characteristic as illustrated in FIG. 8 and produces a voltage proportional to the frequency of the a.c. signal. The voltage in turn is applied as a judging reference to the fire judging section 12. Thus, the sensor responds to the sensitivity change command from the receiver to change its fire detection sensitivity in response to the sensitivity detection command.

The operations of the sensitivity change command and the sensitivity change control will be described. The timer circuit 2 produces the clock signals at a repetition interval of 24 hours. The clock signal is applied through the input interface 3 to the computer 4. The CPU 4*a* reads out the sensitivity command at the present time, as illustrated in FIG. 4, from the ROM 4*b* by using the time data of the clock signal as address data. The sensitivity command in the form of a digital signal is converted to an analog voltage signal by the output interface 5 and the converted voltage signal is applied to the V-F converters 6*a*, . . . , 6*n*. The V-F converters 6*a*, . . . , 6*n* apply a.c. signals having a frequency corresponding to the sensitivity change command to the sensor lines La, . . . , Ln, through the capacitors Ca, . . . , Cn, respectively. The a.c. signals transferred to the sensor lines La, . . . , Ln are supplied to the sensors Sa1 to Sal, . . . , Sn1 to Snm. In each of the sensors, the a.c. signal is applied to the F-V converter 14 through the capacitor Co. Thus, the F-V converter 14 responds to the sensitivity change command signal from the receiver 1 to apply a reference voltage representative of the fire detection sensitivity as a judging reference at the present time to the fire judging section 12. Thus, the sensitivity of the sensors Sa1 to Sal, . . . , Sn1 to Snm are changed to the present sensitivity directed by the receiver 1. In this way, the group of the fire sensors Sa1 to Sal in the fire sensing system 8*a* has the fire detection sensitivity with a profile as shown in FIG. 4 over a period of 24 hours. With such a sensitivity varying according to the time of day, the fire detection system provides a monitoring condition allowing an early discovery of fires to minimize the demage by fires. Also in the remaining fire sensing systems 8*b*, . . . , 8*n*, a sensitivity pattern which is preset independently for each fire sensing system automatically changes the sensitivity of each of the fire sensor groups in a similar manner to provide an optimum fire monitoring condition.

Further, the sensitivity pattern to be stored in the ROM 4*b* may be stored as a desired pattern in accordance with fire monitoring circumstances and therefore can be modified to be best fitted to the circumstances in accordance with the change of the circumstances.

For example, the sensitivity pattern may be common for all the fire sensing systems 8*a*, . . . , 8*n*. When the fire sensing systems 8*a*, . . . , 8*n* are installed independently for the respective floors, it is desirable that the respective sensitivity patterns corresponding to the respective floors may be determined in view of business or living conditions on the respective floors. Those sensitivity patterns thus determined can be written into different memory areas of the ROM 4*b*. The memory areas may be simultaneously accessed by the same clock signal from the timer circuit 2 via the input interface 3.

While the sensitivity pattern is basically repeated at an interval of 24 hours, two different patterns may be preset for a weekday and a holiday, since the activities of people are different between a weekday and a holiday. In this case, a timer with a calendar function capable of producing an output discriminating the weekday from holiday, for example, the A-145 of the AI Electronics Corporation, may be used for the timer circuit 2 shown in FIG. 2. Further, the sensitivity patterns for weekday and holiday are stored in the ROM 4*b*, so that the discriminating output from the timer circuit 2 selects one of the two patterns.

Figure 9:
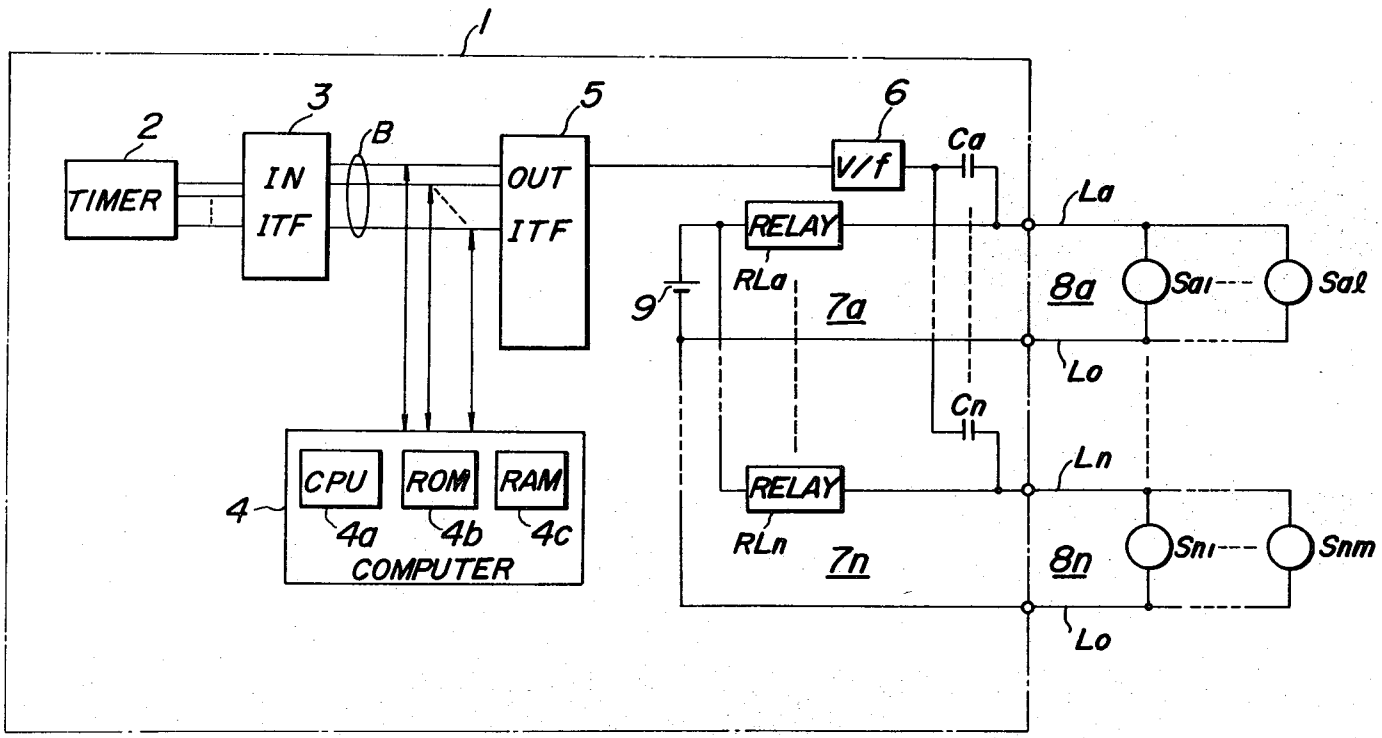
FIG. 9 is a block diagram showing another embodiment of a fire detection system according to the present invention.

FIG. 9 shows another embodiment of a fire detection system according to the invention which is a simplification of the circuit configuration shown in FIG. 5, in case that a common sensitivity pattern is preset for all the fire sensing systems 8*a*, . . . , 8*n*. In the present embodiment, a single V-F converter 6 is employed. The input terminal of the V-F converter 6 is connected to the output interface 5 and the output terminal of the converter 6 is connected in common to the capacitors Ca, . . . , Cn. The remaining portions of the present embodiment are the same as shown in FIG. 5.

Figure 10:
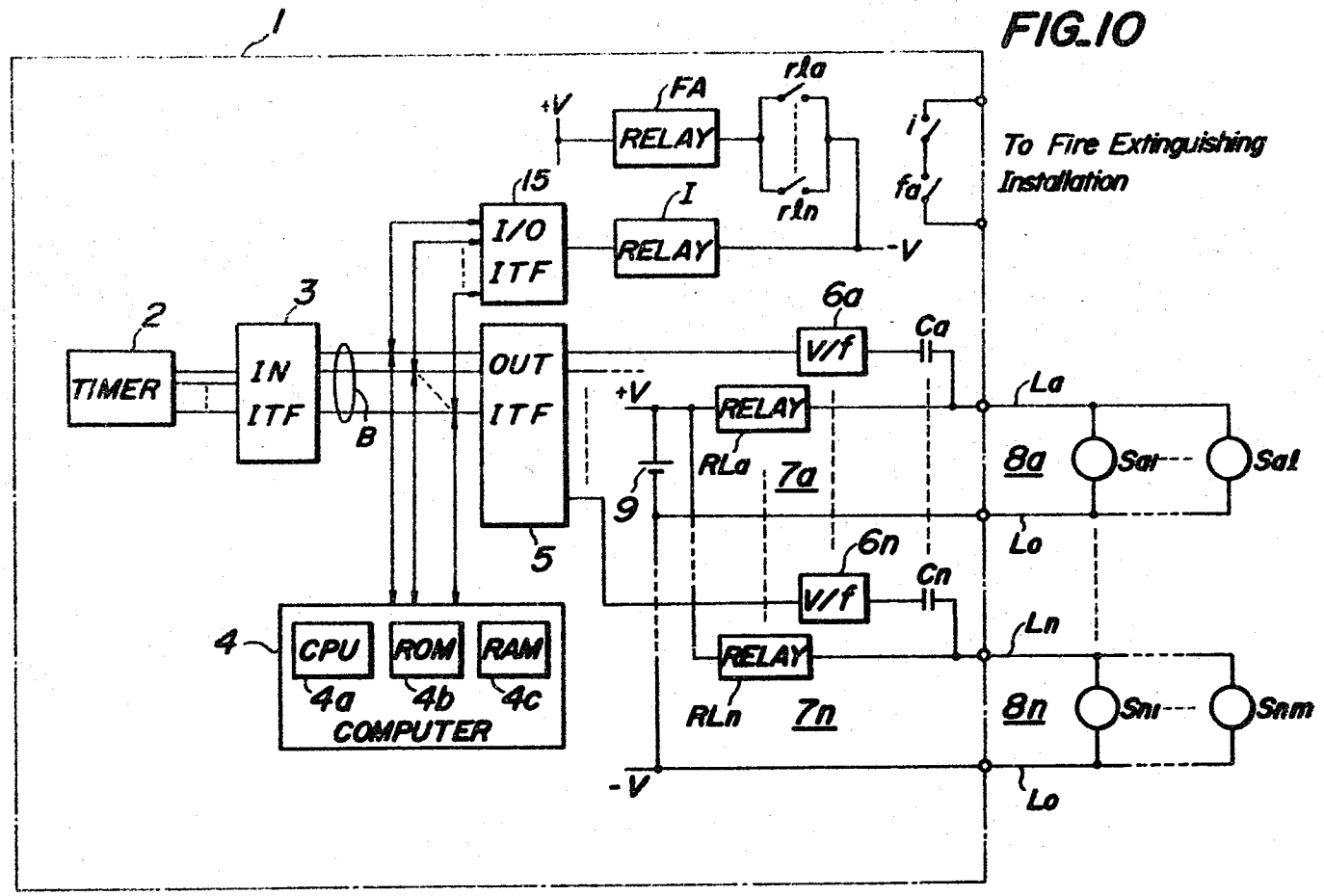
FIG. 10 is a block diagram showing a further embodiment of a fire detection system according to the present invention.

In order to use a fire detection system according to the present invention in a circumstance such as nighttime during which fire damage is likely to expand, the fire detection system may be interlocked with a fire extinguishing installation only during a time zone during which the sensitivity command exceeds a predetermined value. In addition to an early fire extinguishing capability due to the increase of the sensitivity, this interlock provides an effective initial fire extinguishment to remarkably reduce the rate of fire occurrences. An embodiment to realize this interlock is shown in FIG. 10. In the present embodiment, an I/O interface 15 such as an iSBC508 of Intel is coupled to the bus B. When the preset sensitivity exceeds a given value, for example, a sensitivity A2 in FIG. 4, i.e. during the night such as from 0:00 a.m. to 7:00 a.m., the output signal is produced from the I/O interface 15 to energize an interlock enabling relay I to close the normally opened contact i thereof. Normally opened contacts rla, . . . , rln of the receiving relays RLa, . . . , RLn are connected in parallel with one another, and a series circuit of those parallel contacts and a fire alarm relay FA is inserted between the terminals +V and −V of the power source 9. The fire alarm relay FA is energized to close the normally opened contact fa when any one of the receiving relays RLa to RLn corresponding to the fire sensing systems 8*a*, . . . , 8*n* is operated. The contacts i and fa are connected in series to obtain a contact signal to be transferred as an interlock signal of a fire extinguishing command to a fire extinguishing installation (not shown). As described above, in the present embodiment the relay I is kept energized while the sensitivity exceeds A2, that is, during the night. Accordingly, the contact i is closed under this time condition. Under this condition, if any one of the fire sensing systems 8*a*, . . . , 8*n* operates, the contact fa is also closed to produce the interlock signal.

Figure 11:
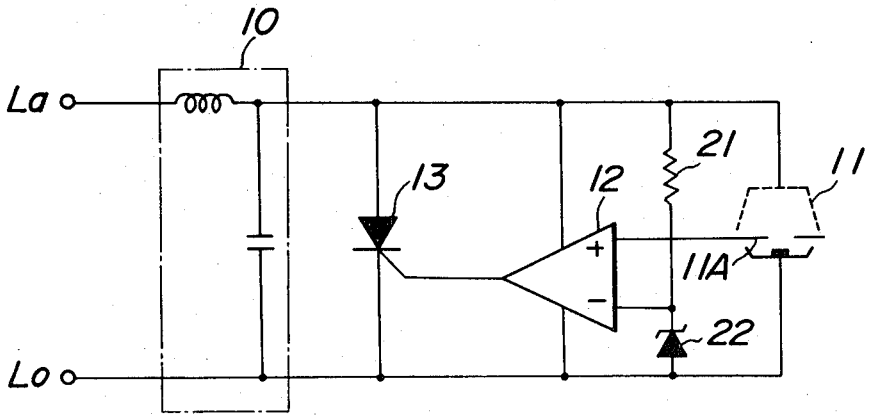
FIG. 11 is a circuit diagram showing another embodiment of a fire sensor used in the fire detection system according to the present invention.
Figure 12:
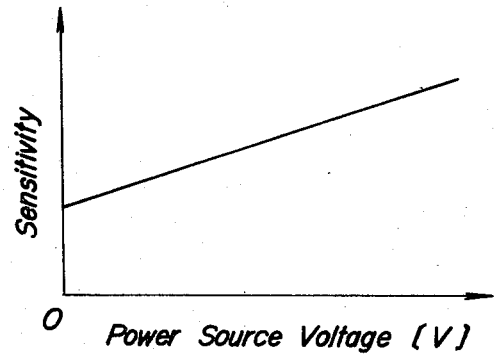
FIG. 12 illustrates the relationship between a power source voltage and the sensitivity.
Figure 13:
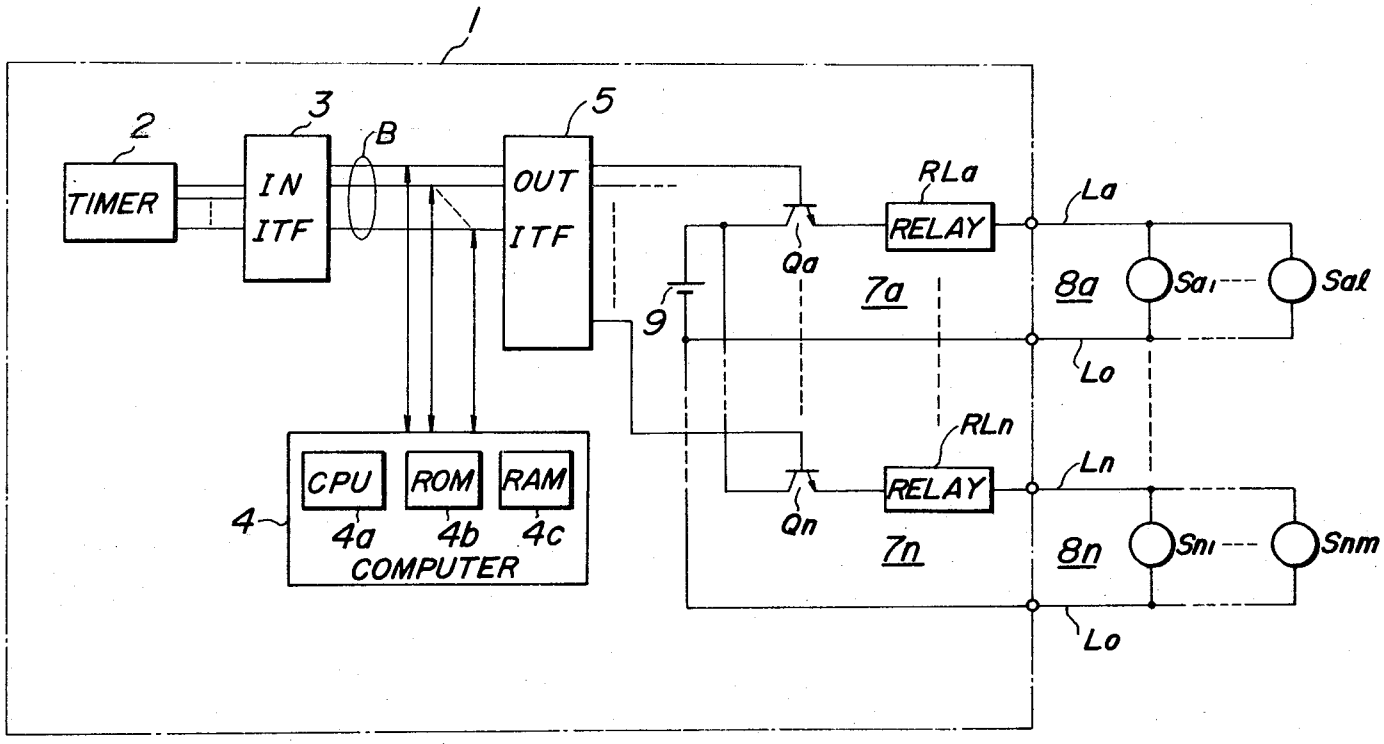
FIG. 13 is a block diagram showing still a further embodiment of a fire detection system using the fire sensor shown in FIG. 11.

Alternatively, the power source voltage on the sensor line may be changed in order to control the sensitivity change of the sensor in accordance with the sensitivity change command from the receiver 1. An embodiment to realize this alternative according to the invention is shown in FIGS. 11, 12 and 13. In FIG. 11 showing an embodiment of a sensor of which the sensitivity changes in accordance with the voltage of the power source, the same numerals are used to designate like portions in FIG. 7. The reference input voltage applied to the negative input terminal of the operational amplifier 12 as the fire judging section is derived from a constant voltage circuit including a series circuit of a resistor 21 and a Zener diode 22 connected across the low-pass filter 10. The potential at the intermediate electrode 11A of the smoke sensing portion 11, which is applied to the positive input terminal of the operational amplifier 12, increases in proportion to the power source voltage obtained from the low-pass filter 10. Accordingly, when the power source voltage applied between the lines La and Lo is varied in accordance with the sensitivity change command, as will be explained with reference to FIG. 13, the potential at the positive input terminal of the operational amplifier 12 also varies corresponding to the change of the power source voltage, so that the sensitivity of the sensor is controlled to be changed by the power source voltage, as illustrated in FIG. 12. A receiver in the present embodiment may be arranged as shown in FIG. 13. In FIG. 13, the outputs from the output interface 5 are supplied to the bases of power transistors, for example, Qa, . . . , Qn, respectively. The collectors of these transistors Qa, . . . , Qn are connected in common to the power source 9. The emitters of the transistors Qa, . . . , Qn are connected to the corresponding receiving relays RLa, . . . , RLn, respectively. In response to the voltages applied to the bases of the respective transistors Qa, . . . , Qn, i.e., in response to the sensitivity change commands, the output voltages from the respective emitters change and are applied between the lines La, . . . , Ln and Lo, respectively.

As described in the foregoing, the present invention employs the sensitivity pattern preset on the basis of damage prediction considering a fire probability such as $P_L$ or $P_F$ in view of a probability of non-fire alarm occurrences according to the time of day in a fire monitoring area and the receiver transmits the sensitivity change command to the sensor groups in accordance with the predetermined sensitivity pattern as the time lapses during 24 hours. In the sensor, the detection sensitivity is changed according to the time of day in response to the command. Therefore, the present invention can achieve a fire monitoring system in which the detection sensitivity is increased to allow an early discovery of a fire during a time zone during which the expansion of a a fire damage is predicted and the detection sensitivity is lowered during a time zone during which prompt fire extinguishing activities are expected, so that an erroneous non-fire alarm is prevented from being issued by any cause other than a fire. According to the invention, the fire damage during night expressed by $P_L$, $P_F$ or the like can be reduced to a level substantially corresponding to the level during daytime and therefore the reliability of a fire sensor itself can be remarkably increased.

What is claimed is:

1. A fire detection system, comprising:

at least one fire sensor having a changeable detection sensitivity for producing a fire detection signal and including sensitivity change control means for changing the detection sensitivity in response to any one of a plurality of predetermined detection sensitivity change commands;

a receiver including a timer for producing a clock signal corresponding to the time of day, command means for providing the predetermined detection sensitivity change commands in response to the clock signal, said change commands being programmed according to the time of day, a power source connected to said fire sensor for supplying a power source voltage to said fire sensor, and a receiving relay for receiving the fire detection signal;

at least one power/signal line for coupling said fire sensor to said receiver; and, wherein said command means includes a computer having a read only memory for storing a detection sensitivity pattern programmed according to the time of day, said computer reading out from said read only memory, in response to said clock signal from said timer, present a detection sensitivity signal, converting means for converting said present detection sensitivity signal to a frequency signal, and at least one first capacitor inserted between said converting means and said at least one power/signal line, and said fire sensor further includes a low-pass filter and a second capacitor which are connected to said power/signal line, a smoke sensing portion and a fire judging section to both of which a power source voltage derived from said low-pass filter is applied and a switching element for producing said fire detection signal, said frequency signal being supplied through said second capacitor to said sensitivity change control means, and a sensitivity change control signal derived from said sensitivity change control means and an output signal from said smoke sensing portion are supplied to said fire judging section, so that the switching of said switching element is controlled by the output signal from said fire judging section.

2. A fire detection system as claimed in claim 1, wherein said detection sensitivity signal derived from said computer is in the form of a digital signal, said converting means includes a D/A converter for converting said digital signal to an analog voltage and a V-F converter for converting said analog voltage to said frequency signal, said sensitivity change control means has an F-V converter for converting said frequency signal into a voltage signal, said fire judging section has an operational amplifier, and said switching element is a thyristor having a gate connected to the output terminal of said operational amplifies and an anode and a cathode which are connected to said low-pass filter.

3. A fire detection system as claimed in claim 1, further comprising an interlock enabling relay which operates when said present detection sensitivity signal produced from said command means exceeds a predetermined value, and a fire alarm relay which operates when said receiving relay operates, whereby a fire extinguishing installation is operated when said fire alarm relay operates under a condition that said interlock enabling relay operates.

4. A fire detection system as claimed in claim 1, wherein two types of sensitivity patterns for a weekday and a holiday are written in said read only memory.

5. A fire detection system, comprising:

at least one fire sensor having a changeable detection sensitivity for producing a fire detection signal and including sensitivity change control means for changing the detection sensitivity in response to any one of a plurality of predetermined detection sensitivity change commands;

a receiver including a timer for producing a clock signal corresponding to the time of day, command means for providing the predetermined detection sensitivity change commands in response to the clock signal, said change commands being programmed according to the time of day, a power source connected to said fire sensor for supplying a power source voltage to said fire sensor, and a receiving relay for receiving the fire detection signal;

at least one power/signal line for coupling said fire sensor to said receiver; and, wherein a plurality of fire sensors are provided corresponding to a plurality of fire sensing systems, respectively, said command means includes a computer having a read only memory for storing a plurality of detection sensitivity patterns programmed according to the time of day corresponding to said plurality of fire sensing systems, said computer reading out from said read only memory, in response to said clock signal from said timer, present detection sensitivity signals corresponding to the respective fire sensing systems, converting means for converting said detection sensitivity signals to frequency signals, respectively, and a plurality of first capacitors connected respectively between said converting means and a plurality of power/signal lines corresponding to said fire sensing systems, and each of said fire sensors includes a low-pass filter and a second capacitor which are connected to said power/signal line, a smoke sensing portion and a fire judging section, to both of which a power source voltage derived from said low-pass filter is applied, and a switching element for producing said fire detection signal, said frequency signal being supplied through said second capacitor to said sensitivity change control means, and a sensitivity change control signal derived from said sensitivity change control means and an output signal from said smoke sensing portion are supplied to said fire judging section, so that the switching of said switching element is controlled by the output signal from said fire judging section.

6. A fire detection system as claimed in claim 5, further comprising an interlock enabling relay which operates when said present detection sensitivity signals produced from said command means exceed a predetermined value, and a fire alarm relay which operates when said receiving relay operates, whereby a fire extinguishing installation is operated when said fire alarm relay operates under a condition that said interlock enabling relay operates.

7. A fire detection system, comprising:

at least one fire sensor having a changeable detection sensitivity for producing a fire detection signal and including sensitivity change control means for changing the detection sensitivity in response to any one of a plurality of predetermined detection sensitivity change commands;

a receiver including a timer for producing a clock signal corresponding to the time of day, command means for providing the predetermined detection sensitivity change commands in response to the clock signal, said change commands being programmed according to the time of day, a power source connected to said fire sensor for supplying a power source voltage to said fire sensor, and a receiving relay for receiving the fire detection signal;

at least one power/signal line for coupling said fire sensor to said receiver; and, wherein a plurality of fire sensors are provided corresponding to a plurality of fire sensing systems, respectively, said command means includes a computer having a read only memory for storing a detection sensitivity pattern programmed according to the time of day, said computer reading out from said read only memory, in response to said clock signal from said timer, present detection sensitivity signals corresponding to the respective fire sensing systems, converting means for converting said present detection sensitivity signals to frequency signals, and first capacitors connected between said converting means and a plurality of power/signal lines corresponding to said fire sensing systems, and each of said fire sensors includes a low-pass filter and a second capacitor which are connected to said power/signal lines, a smoke sensing portion and a fire judging section, to both of which a power source voltage derived from said low-pass filter is applied, and a switching element for producing said fire detection signal, said frequency signal being supplied through said second capacitor to said sensitivity change control means, and a sensitivity change control signal derived from said sensitivity change control means and an output signal from said smoke sensing portion are supplied to said fire judging section, so that the switching of said switching element is controlled by the output signal from said fire judging section.

8. A fire detection system as claimed in claim 7, further comprising an interlock enabling relay which operates when said present detection sensitivity signal produced from said command means exceeds a predetermined value, and a fire alarm relay which operates when said receiving relay operates, whereby a fire extinguishing installation is operated when said fire alarm relay operates under a condition that said interlock enabling relay operates.

9. A fire detection system, comprising:

at least one fire sensor having a changeable detection sensitivity for producing a fire detection signal and including sensitivity change control means for changing the detection sensitivity in response to any one of a plurality of predetermined detection sensitivity change commands;

a receiver including a timer for producing a clock signal corresponding to the time of day, command means for providing the predetermined detection sensitivity change commands in response to the clock signal, said change commands being programmed according to the time of day, a power source connected to said fire sensor for supplying a power source voltage to said fire sensor, and a receiving relay for receiving the fire detection signal;

at least one power/signal line for coupling said fire sensor to said receiver; and, wherein said command means includes a computer having a read only memory for storing at least one detection sensitivity pattern programmed according to the time of day, said computer reading out from said read only memory, in response to said clock signal from said timer, at least one present detection sensitivity signal, and power source voltage control means for changing the power source voltage derived from said power source in response to said present detection sensitivity signal to supply the changed power source voltage to said receiving relay and said fire sensor, said sensor includes a low-pass filter connected to said at least one power/signal line, and a smoke sensing portion, a fire judging section, a constant voltage circuit and a switching element for producing said fire detecting signal to which the power source voltage from said low-pass filter is applied, a sensed output signal from said smoke sensing portion and a reference level from said constant voltage circuit being supplied to said fire judging section, so that the switching of said switching element is controlled by the output signal from said fire judging section.

10. A fire detection system as claimed in claim 9, wherein said power source voltage control means is a transistor having a base receiving the present detection sensitivity signal and a collector and an emitter which are inserted between said power source and said receiving relay.

11. A fire detection system as claimed in claim 9, further comprising an interlock enabling relay which operates when said at least one present detection sensitivity signal produced from said command means exceeds a predetermined value, and a fire alarm relay which operates when said receiving relay operates, whereby a fire extinguishing installation is operated when said fire alarm relay operates under a condition that said interlock enabling relay operates.

12. A fire detection system, comprising:

at least one fire sensor having a changeable detection sensitivity for producing a fire detection signal and including sensitivity change control means for changing the detection sensitivity in response to any one of a plurality of predetermined detection sensitivity change commands;

a receiver including a timer for producing a clock signal corresponding to the time of day, command means for providing the predetermined detection sensitivity change commands in response to the clock signal, said change commands being programmed according to the time of day, a power source connected to said fire sensor for supplying a power source voltage to said fire sensor, and a receiving relay for receiving the fire detection signal;

at least one power/signal line for coupling said fire sensor to said receiver; and, further comprising an interlock enabling relay which operates when said at least one predetermined sensitivity change command produced from said command means exceeds a predetermined value, and a fire alarm relay which operates when said receiving relay operates, whereby a fire extinguishing installation is operated when said fire alarm relay operates under a condition that said interlock enabling relay operates.

* * * * *

UNITED STATES PATENT AND TRADEMARK OFFICE

CERTIFICATE OF CORRECTION

PATENT NO. : 4,388,616

DATED : June 14, 1983

INVENTOR(S) : HARUCHIKA MACHIDA

It is certified that error appears in the above-identified patent and that said Letters Patent is hereby corrected as shown below:

Column 11, line 1, "amplifies" should be "amplifier".

Signed and Sealed this

*Twenty-fifth* Day of *October 1983*

[SEAL]

*Attest:*

GERALD J. MOSSINGHOFF

*Attesting Officer* *Commissioner of Patents and Trademarks*